United States Patent [19]

Bindernagel et al.

[11] 4,313,326

[45] Feb. 2, 1982

[54] CONTINUOUS ROLLING LINES AND METHODS FOR ROLLING WIRES OR BARS

[75] Inventors: Ali Bindernagel, Wermelskirchen; Ernst O. Blos, Hochdahl, both of Fed. Rep. of Germany

[73] Assignee: Kocks Technik GmbH & Co., Düsseldorf, Fed. Rep. of Germany

[21] Appl. No.: 144,384

[22] Filed: Apr. 28, 1980

[30] Foreign Application Priority Data

Jun. 21, 1979 [DE] Fed. Rep. of Germany ..... 2924954

[51] Int. Cl.[3] ..... B21B 1/18

[52] U.S. Cl. ..... 72/230

[58] Field of Search ..... 72/230, 231, 226, 227

[56] References Cited

U.S. PATENT DOCUMENTS 1,932,750 10/1933 Rendleman ..... 72/230 X 3,197,993 8/1965 Hein et al. ..... 72/230

*Primary Examiner*—Milton S. Mehr

*Attorney, Agent, or Firm*—Buell, Blenko, Ziesenheim & Beck

[57] ABSTRACT

A continuous rolling line and method for rolling wires or bars is provided using at least one repeater rolling unit of at least two roll stands having a rolled stock loop between them and a multi-stand continuous rolling unit spaced from and receiving rolled stock from the repeater rolling unit.

5 Claims, 1 Drawing Figure

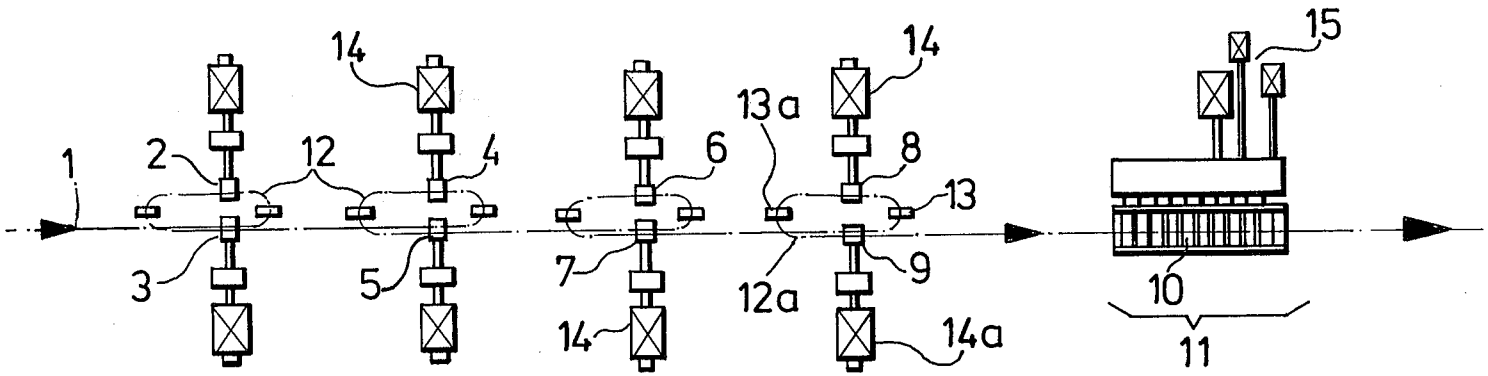
1
2
3
12
14
4
5
6
7
14
13a
12a
14
8
13
9
14a
15
10
11

CONTINUOUS ROLLING LINES AND METHODS FOR ROLLING WIRES OR BARS

This invention relates to continuous rolling lines and methods for rolling wires or bars and particularly to a continuous rolling line for the hot rolling of wires or bars, especially low and high alloy steels and difficultly formable non-ferrous metals and/or alloys.

In the past repeater rolling lines or trains have primarily been used for the rolling of difficultly deformable materials because the heat generated by the deformation of the rolled stock cross section in the individual passes and the resulting temperature rise in the rolled stock are essentially compensated by the fact that the rolled stock traverses a relatively long path during passage to the next pass and thus has an opportunity to cool down.

However, repeater rolling trains have the substantial disadvantage that the rolling speeds attainable are relatively low. A flawless feed into the subsequent pass and a reliable and trouble-free passage of the rolled stock are not assured above speeds of about 25–30 meters per second; thus, in contrast to continuous rolling trains that consist of several rolling units and attain rolling speeds of 60 meters per second or more, repeater rolling trains run relatively slowly and have a correspondingly lower capacity.

Continuous rolling trains that consist of several successive rolling units cannot be run with a high rolling speed of 60 meters per second or more either in the case of difficultly deformable rolled stock, especially if the pass consists of only two rolls, because the roll stock then becomes heated above the maximum permissible temperature and would thus be damaged. In the numerous, close-following passes of several rolling units the roll stock would be quite substantially heated by the deformation and there would not be a sufficient opportunity for cooling to occur, as is the case in repeater rolling trains.

The present invention envisions a continuous rolling train for the hot-rolling of wire or bars of difficultly deformable materials, with which a higher emergence speed of the roll stock and thus a higher capacity are attainable.

This result is achieved in accordance with the invention in that the outlet portion of the rolling train consists of at least one multi-stand rolling unit, familiar in itself, into which the roll stock enters in a traction-free and pressure-free manner by means of an adjustable rolled stock loop located in front of the rolling unit.

The result of this is that on the inlet side the rolled stock has a chance to cool in the region of the passages beyond its roll pass and an inadmissible temperature rise in the rolled stock is thus avoided. Because the rolling speeds on the inlet side are lower than on the outlet side since the rolled stock is not as intensely stretched on the inlet side, the said difficulties are not manifested during the passage of the rolled stock and introduction into the passes either. Then if the rolling speed becomes so great on the outlet side of the rolling train according to the invention with progressive stretching that repeater roll stands are no longer suitable there, a nonkinking rolling unit suitable for the higher speeds is available for the remaining deformation. Thus, by employing the rolling unit on the outlet side, especially if its passes are made up of three or more rolls, it is possible to attain higher emergence speeds than would be possible with a mere repeater rolling train. The heating in the rolling unit on the outlet side is thus maintained within admissible limits because the rolled stock is relatively cool when it enters this last rolling unit, i.e., without additional heating due to the preliminary and intermediate units that are otherwise usually intercalated. A higher emergence speed and thus a greater capacity are thereby achieved without the rolled stock becoming inadmissibly heated or disturbances being manifested as a consequence of excessively high rolling speeds. The combination of the familiar repeater rolling mill with the also familiar rolling units according to the invention accordingly facilitates a substantial increase in the capacity.

In order to assure a flawless operation of the rolling unit on the outlet side, the rolled stock must enter this rolling unit in a traction-free and pressure-free manner. A rolled stock loop is provided for this purpose, as is usually done already in the case of continuous rolling trains between the individual rolling units. In another implementation of the invention, however, the repeater loops in front of the last repeater roll stand serve as the rolled stock loop. In this manner, the additional arrangement of a roll stock loop is dispensed with and a rolled stock loop that is already present is used instead. This simplifies and reduces the cost of the rolling train, decreases the susceptibility to disturbances, and saves additional regulating devices because the loops of the repeater roll stands must be monitored and regulated anyway, and the installation is shortened by the dropping out of an additional loop, thus minimizing the space requirement.

It is advisable to couple the drives of the last repeater roll stand and the subsequent rolling unit together and regulate them as a function of the size of the repeater loop in front of the last repeater roll stand. A flawless tractionless and pressureless entrance of the rolled stock into the subsequent rolling unit is thus assured. The coupling of the drives is usually electric, although other coupling types are also conceivable.

The invention is illustrated in the accompanying drawing by means of an implementation example in schematic form. The path of the rolled stock in the direction of the arrow is indicated by 1 and dot-dash lines. The rolled stock thus passes through the roll stands indicated by 2–9, in which it is rolled in a pass in the sequence of the reference numbers before it is passed through the roll stands (indicated by 10) of the rolling unit 11.

The roll stands 2–9 are repeater roll stands, in which case a rolled stock loop 12 is present between them. With the aid of familiar monitoring devices 13, the sizes of these loops 12 are monitored and the drives (indicated by 14) are regulated such that the loops 12 are formed and remain essentially the same size.

The rolled stock loop indicated by **12*a* in front of the last repeater roll stand 9 simultaneously serves as a rolled stock loop for the tractionless and pressureless insertion of the rolled stock into the rolling unit 11. Its monitoring and regulating arrangement 13*a* regulates the drive 14*a* of the repeater roll stand 9 together with the drive 15 of the rolling unit 11 so that this loop 12*a*** also remains essentially of the same size.

In the foregoing specification we have set out certain preferred practices and embodiments of our invention, however, it will be understood that this invention may be otherwise embodied within the scope of the following claims.

We claim:

1. A continuous rolling line for the hot rolling of wire or bars, particularly of alloy steels and difficulty deformable metals and/or alloys comprising at least one repeater rolling unit of at least two stands receiving metal for rolling, an adjustable rolled stock loop incorporated between said at least two stands of said repeater rolling unit, and at least one multi-stand continuous rolling block unit spaced from said repeater rolling unit receiving rolled stock directly from said rolled stock loop of the repeater rolling unit in a traction and compression free manner and forming the exit section of said lines.

2. A rolling line according to claim 1, characterized in that the repeater loop in front of the last repeater roll stand of the at least one repeater rolling unit serves as the rolled stock loop.

3. A rolling train according to claims 1 or 2, having drive means for each repeater roll stand and the continuous rolling unit, said drives of the last repeater roll stand of the at least one repeater rolling unit and the following multi-stand continuous rolling unit being coupled together and adjusted or regulated as a function of the size of the repeater loop in front of the last repeater stand.

4. The method of rolling wire or bars comprising the steps of:

(a) reducing said wire or bars in at least one repreater rolling unit of at least two stands, (b) forming a rolled stock loop between said at least two stands of the repeater rolling unit, (c) passing the reduced wire or bar from the repeater rolling unit directly to a multi-stand continuous rolling block exit unit, and (d) controlling the speed of multi-stand continuous rolling unit and the repeater rolling unit to maintain the size of the rolled stock loop within preselected size parameters.

5. A method as claimed in claim 4 wherein the speed of the multi-stand continuous rolling unit and the speed of the last stand of the last of the at least one repeater rolling unit are simultaneously regulated as a function of the size of the repeater loop in front of the said last stand of the last of the at least one repeater rolling unit.

* * * * *